US009680256B1

(12) United States Patent
Lane et al.

(10) Patent No.: US 9,680,256 B1
(45) Date of Patent: Jun. 13, 2017

(54) CONNECTOR SYSTEM WITH CONNECTOR POSITION ASSURANCE

(71) Applicant: TYCO ELECTRONICS CORPORATION, Berwyn, PA (US)

(72) Inventors: David James Lane, Hummelstown, PA (US); James Michael Raudenbush, Halifax, PA (US); Douglas John Hardy, Middletown, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/073,149

(22) Filed: Mar. 17, 2016

(51) Int. Cl.
*H01R 13/627* (2006.01)
*H01R 13/631* (2006.01)

(52) U.S. Cl.
CPC ..... *H01R 13/6273* (2013.01); *H01R 13/631* (2013.01)

(58) Field of Classification Search
CPC ..... H01R 13/639
USPC ..... 439/352, 489
See application file for complete search history.

(56) References Cited

U.S. PATENT DOCUMENTS 5,681,178 A * 10/1997 Kunkle ..... H01R 13/641 439/352
6,435,895 B1 * 8/2002 Fink ..... H01R 13/6272 439/352
6,491,542 B1 * 12/2002 Zerebilov ..... H01R 13/4226 439/352
6,780,045 B2 * 8/2004 Shuey ..... H01R 13/641 439/352
7,347,745 B1 * 3/2008 Raudenbush ..... H01R 13/4223 439/595
7,544,081 B2 * 6/2009 Lim ..... H01R 13/4361 439/352
7,762,854 B1 * 7/2010 Peng ..... H01R 13/508 439/578
8,678,846 B2 3/2014 Hitchcock et al.
8,747,146 B2 * 6/2014 Brown ..... H01R 13/639 439/489
9,281,619 B2 * 3/2016 Morello ..... H01R 13/6272

* cited by examiner

*Primary Examiner* — Neil Abrams

(57) ABSTRACT

An electrical connector includes a housing and a connector position assurance (CPA) element. The CPA element includes a beam that is deflected from a blocked position to a clearance position by a mating connector that is loaded into a cavity of the housing. When the beam is in the blocked position, movement of the CPA element from an extended position to an inserted position is mechanically blocked by a protrusion of the housing that abuts the beam. The beam of the CPA element, when moved to the clearance position, clears the protrusion to allow the CPA element to move from the extended position to the inserted position. The housing may include a pair of such deflectable beams, each with a slot having an opening at its distal end. The opening of one of the beams aligns with the protrusion when the beam is deflected to its clearance position.

20 Claims, 6 Drawing Sheets

CONNECTOR SYSTEM WITH CONNECTOR POSITION ASSURANCE

BACKGROUND OF THE INVENTION

The subject matter herein relates generally to connector systems, and more specifically to connector systems that provide connector position assurance.

In some connector systems, a coupling mechanism is used when a first connector is mated to a second connector to secure the first and second connectors together. The first and second connectors are secured together to ensure that the connector system can withstand forces that would tend to pull the connectors apart and break the conductive pathway that is formed between the connectors when mated to each other. In some embodiments, the coupling mechanism is defined by a latch on one connector that engages a catch of a mating connector when the two connectors are fully mated.

One problem with connector systems is that connectors may unintentionally uncouple or un-mate, causing operating errors due to breaking the conductive signal path between the connectors. The connectors may become un-mated due to, for example, the connectors never achieving a fully mated connection during assembly, such that the latch of the one connector does not properly engage the catch of the other connector. Another potential cause for the unintentional un-mating of the connectors is the latch releasing from the catch after the two connectors have been fully mated which allows the connectors to un-mate. The latch may release from the catch due to a force exerted on the latch from an external object.

The connector system may be used in a complex manufactured product, such as an automobile. If two connectors in a connector system become un-mated from each other during or after assembly of the automobile, an error caused by the break in the conductive pathway may be difficult to discover and/or remedy. For example, it may be difficult to identify and access a faulty connection between two connectors in the automobile that includes numerous connections.

Due to physical characteristics such as small size and shielded conductors, it may be difficult for a worker (or even a machine) to accurately recognize whether two mating connectors are fully mated together at an assembly facility. For example, two connectors that are not fully mated to each other may be less than a millimeter (or a few millimeters) off from the fully mated positions of the connectors, which may be difficult for the worker and/or the machine to identify. A need remains for a connector system that provides assurance that two connectors are fully mated to each other and will not unintentionally un-mate from each other in order to avoid errors caused by breaks in the conductive pathway defined by the connectors.

BRIEF DESCRIPTION OF THE INVENTION

In an embodiment, an electrical connector is provided that includes a housing and a connector position assurance (CPA) element. The housing has a front end and defines a cavity at the front end that is configured to receive a mating connector therein. The housing includes a first protrusion that defines a hard stop surface. The CPA element is mounted on the housing and moveable relative to the housing between an extended position and an inserted position. The CPA element, when in the inserted position, is disposed more proximate to the front end of the housing than when the CPA element is in the extended position. The CPA element includes a base and a first beam extending from the base towards the front end of the housing. The first beam is configured to be engaged by the mating connector and deflected from a blocked position to a clearance position as the mating connector is loaded into the cavity. When the first beam of the CPA element is in the blocked position, movement of the CPA element from the extended position to the inserted position is mechanically blocked by the hard stop surface of the first protrusion abutting the first beam of the CPA element. When the first beam of the CPA element is moved to the clearance position by the mating connector, the first beam clears the hard stop surface of the first protrusion to allow the CPA element to be moved from the extended position to the inserted position.

In another embodiment, an electrical connector is provided that includes a housing and a connector position assurance (CPA) element. The housing has a front end and defines a cavity at the front end that is configured to receive a mating connector therein. The housing includes a first protrusion that defines a hard stop surface. The CPA element is mounted on the housing and moveable relative to the housing between an extended position and an inserted position. The CPA element, when in the inserted position, is more proximate to the front end of the housing than when the CPA element is in the extended position. The CPA element includes a base and two beams extending from the base towards the front end of the housing. The beams are spaced apart from one another by a gap. The beams are configured to receive a tab of the mating connector into the gap as the mating connector is received in the cavity. The tab engages and deflects the first and second beams laterally outward relative to one another from a blocked position of the beams to a clearance position of the beams. When the beams of the CPA element are in the blocked position, movement of the CPA element from the extended position to the inserted position is mechanically blocked by the hard stop surface of the first protrusion abutting at least one of the beams of the CPA element. When the beams of the CPA element are in the clearance position, the beams clear the hard stop surface of the first protrusion to allow the CPA element to be moved from the extended position to the inserted position.

In another embodiment, an electrical connector is provided that includes a housing and a connector position assurance (CPA) element. The housing has a body, a coupling lever, and a first protrusion. The body defines a cavity at a front end of the housing that is configured to receive a mating connector therein. The coupling lever is pivotable relative to the body about a fulcrum. The coupling lever includes a latching surface that engages a catch of the mating connector when the mating connector is in a fully mated position to secure the mating connector to the housing. The first protrusion defines a hard stop surface. The CPA element is mounted on the housing and disposed between the coupling lever and a platform of the body. The CPA element is slidable between an extended position and an inserted position along a top side of the platform facing the coupling lever. The CPA element, when in the inserted position, is disposed more proximate to the front end of the housing than when the CPA element is in the extended position. The CPA element includes a base and a first beam extending from the base towards the front end of the housing. The first beam is configured to be engaged by the mating connector and deflected from a blocked position to a clearance position as the mating connector is loaded into the cavity. When the first beam of the CPA element is in the blocked position, movement of the CPA element from the extended position to the inserted position is mechanically blocked by the hard stop surface of the first protrusion abutting the first beam of the CPA element. When the first beam of the CPA element is moved to the clearance position by the mating connector, the first beam clears the hard stop surface of the first protrusion to allow the CPA element to be moved from the extended position to the inserted position.

DETAILED DESCRIPTION OF THE INVENTION

Figure 1:
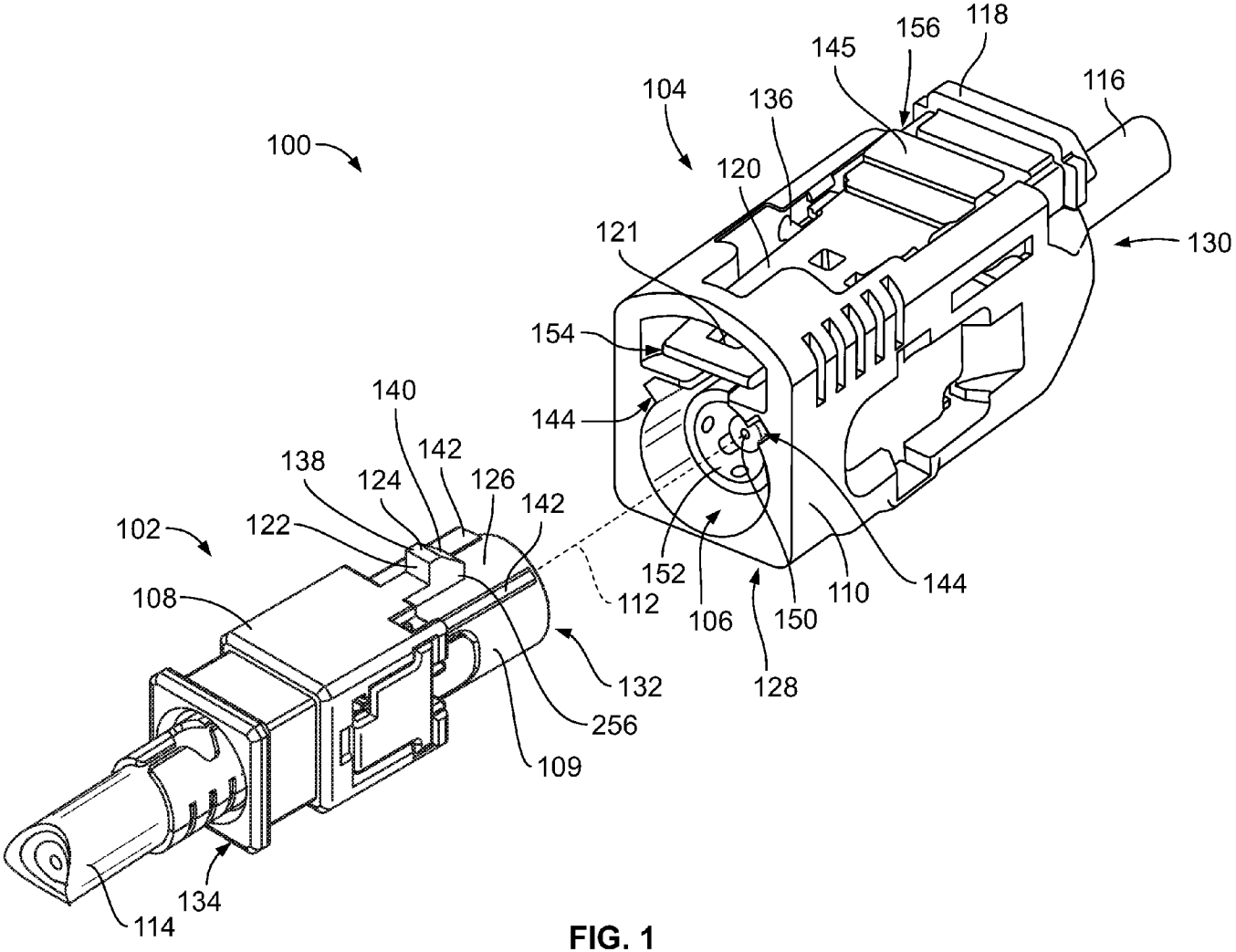
FIG. 1 is a perspective view of a connector system formed in accordance with an embodiment.

One or more embodiments described herein provide a connector system having an electrical connector that includes a connector position assurance (CPA) lever. The CPA element is movable between an extended position and an inserted position. For example, the CPA element can be moved back and forth between the extended position and the inserted position. In the inserted position, the CPA element may be more proximate to a front, mating end of the electrical connector than when the CPA element is in the extended position. In embodiments described herein, the CPA element is configured to only be movable from the extended position to the inserted position in response to the mating electrical connector attaining a fully mated position relative to the housing of the electrical connector. Thus, the CPA element is restricted from moving to the inserted position until the mating electrical connector is fully mated with the electrical connector. Once the mating connector is in a fully mated position relative to the housing of the electrical connector, the CPA element is unrestricted or allowed to move to the inserted position. The CPA element may be moved by a human operator or a robotic machine that pushes or pulls the CPA element in the direction towards the inserted position. The CPA element is a connector position assurance mechanism that is used to verify that the electrical connectors are fully mated to each other by providing sensory (for example, tactile, visual, audible, etc.) feedback to an operator or a robotic machine assembling the connector system. Thus, when an operator sees, feels, and/or hears the CPA element moving to the inserted position after a mating connector is loaded into the housing of the electrical connector, the operator is provided assurance that the mating connector is fully loaded relative to the electrical connector.

In an embodiment, the CPA element also provides a secondary locking mechanism that supports a coupling mechanism that couples the mating connector to the electrical connector. For example, the electrical connector may include a coupling lever that pivots about a fulcrum. The coupling lever includes a latching surface on one side of the fulcrum that is configured to engage a catch of the mating connector when the mating connector is fully loaded to retain the connectors in a mated and/or coupled state. When the CPA element is moved to the inserted position (which only occurs when the connectors are mated), the positioning of the CPA element may restrict and/or prevent pivoting of the coupling lever that would move the latching surface out of engagement with the catch of the mating connector. Thus, when the CPA element is in the inserted position, the CPA element supports the coupling mechanism, preventing, or at least prohibiting, the ability of the mating connector to be un-mated or uncoupled from the electrical connector. In an embodiment, the CPA element is configured to be moved from the inserted position to the extended position to allow the coupling lever to disconnect from the catch of the mating connector for un-mating the connectors.

FIG. 1 is a perspective view of a connector system 100 formed in accordance with an embodiment. The connector system 100 includes a first electrical connector 102 and a second electrical connector 104. In the illustrated embodiment, the first electrical connector 102 is a male connector, and the second electrical connector 104 is a female connector, such that a portion of the first electrical connector 102 is received within a cavity 106 of the second electrical connector 104 during a mating operation. More specifically, a portion of the male housing 108 (e.g., a nose cone) of the first connector 102 is received within the cavity 106 defined by a female housing 110 of the second connector 104. Although shown as un-mated in FIG. 1, the first and second connectors 102, 104 are poised for mating along a mating axis 112. As used herein, the first electrical connector 102 is referred to as male connector 102 or mating connector 102, and the second electrical connector 104 is referred to as female connector 104 or simply as connector 104.

The connector system 100 may be used in numerous applications across various industries, such as the automotive industry, the home appliance industry, the aviation industry, and the like, to electrically couple two or more devices and/or electrical components. For example, in the automotive industry, the electrical connectors 102, 104 may be used for radio frequency communications, such as to electrically connect an antenna to a controller and/or processing device.

The male connector 102 and the female connector 104 each electrically connect to different electrical components and provide a conductive pathway between the corresponding electrical components. In the illustrated embodiment, the male connector 102 and the female connector 104 are electrically connected to corresponding conductive cables or wires 114, 116, such as coaxial cables. In an alternative embodiment, the male connector 102 and/or the female connector 104 may be mounted (e.g., edge-mounted) to a corresponding circuit board. The cable 114 is electrically terminated (e.g., crimped, soldered, etc.) to electrical contacts (not shown) of the male connector 102. The cable 116 is electrically terminated to electrical contacts (for example, a center contact 150 and an outer contact 152) of the female connector 104. The electrical contacts of the male connector 102 engage the electrical contacts 150, 152 of the female connector 104 when the connectors 102, 104 are mated. Various electrical signals conveying power, control messages, data, or the like, may be transmitted through the connectors 102, 104 between the cable 114 and the cable 116.

The male connector 102 and the female connector 104 both have in-line shapes in the illustrated embodiment. For example, the mating axis 112 along which the male connector 102 is loaded into the cavity 106 is generally parallel to the orientation of the cable 114 exiting the male connector 102 and the cable 116 exiting the female connector 104. In an alternative embodiment, the male connector 102 and/or the female connector 104 may have a right angle or other angle shape.

The female housing 110 of the female connector 104 extends between a front end 128 and a rear end 130. The front end 128 is a mating end that faces the male connector 102. The cavity 106 extends at least partially through the female housing 110 between the front end 128 and the rear end 130. The cavity 106 is open at the front end 128. The female connector 104 includes a CPA element 118 that is mounted on the female housing 110. The CPA element 118 is disposed radially outward of the cavity 106, as opposed to being located within or in-line with the cavity 106. In the illustrated orientation of the female connector 104, the CPA element 118 is disposed above the cavity 106. The CPA element 118 is moveable between an extended position and an inserted position relative to the female housing 110. The CPA element 118 is in the extended position in FIG. 1. The CPA element 118 is configured to move linearly in an actuation path between the extended and inserted positions. The actuation path of the CPA element 118 in an embodiment is parallel to the mating axis 112. In the inserted position, the CPA element 118 is more proximate to the front end 128 of the female housing 110 than when the CPA element 118 is in the extended position. The CPA element 118 provides connector position assurance that indicates if the male connector 102 and the female connector 104 are properly mated to one another because the CPA element 118 is configured to only be moveable from the extended position to the inserted position when the male connector 102 is in (or is substantially close to) a fully mated position relative to the female connector 104. As used herein, the fully mated position of the male connector 102 refers to a proper mating position in which the male connector 102 is properly electrically connected to the female connector 104 and the coupling mechanism is locked in order to retain the male and female connectors 102, 104 in the coupled state. Thus, if the male connector 102 is not fully loaded within the cavity 106 of the female connector 104, then the CPA element 118 is blocked from being moved from the extended position to the inserted position.

The female housing 110 includes a coupling lever 120. The coupling lever 120 is mounted to the housing 110 and is pivotable relative to the housing 110 about a fulcrum 136. The coupling lever 120 defines the coupling mechanism of the female connector 104 for selectively locking the female connector 104 to the male connector 102. For example, the coupling lever 120 includes a latching surface 121 that is configured to engage a catch 122 of the male connector 102 to secure the female housing 110 to the male housing 108. The engagement between the latching surface 121 and the catch 122 is designed to absorb and withstand forces incidental to normal use that pull the connectors 102, 104 apart. The coupling lever 120 is configured to pivot radially outward relative to the cavity 106. The coupling lever 120 may pivot responsive to engagement with the male housing 108 as the male connector 102 is loaded into the cavity 106, which lifts a first end 154 of the coupling lever 120 proximate to the latching surface 121. Additionally, or alternatively, the coupling lever 120 may pivot due to depression of a button segment 145 of the coupling lever 120, as described in more detail below. The button segment 145 is disposed proximate to an opposite, second end 156 of the coupling lever 120, and the fulcrum 136 is disposed between the latching surface 121 and the button segment 145.

The male housing 108 extends between a mating end 132 and a back end 134. The male housing 108 is loaded in the cavity 106 such that the mating end 132 is received in the cavity 106, while the back end 134 does not enter the cavity 106. In the illustrated embodiment, the male housing 108 includes a nose cone 109 that has a generally cylindrical shape. The nose cone 109 includes a tab 124 that projects from an outer surface 126 of the nose cone 109. The tab 124 is configured to engage the coupling lever 120. The tab 124 defines the catch 122. The catch 122 is a rear surface of the tab 124 that faces the back end 134 of the housing 108. The tab 124 may pivot the coupling lever 120 as the male connector 102 is loaded. For example, a top side 138 of the tab 124 may define a ramp 140 that engages and gradually increases the pivoting of the coupling lever 120 as the male connector 102 moves along the mating axis 112 towards the fully loaded position. In the fully loaded position, the catch 122 of the tab 124 engages the latching surface 121 of the female housing 110 to secure the male connector 102 to the female connector 104. The nose cone 109 optionally may include at least one keying ridge 142 that projects from the outer surface 126. Each keying ridge 142 is configured to be received in a corresponding key groove 144 along a periphery of the cavity 106 to ensure that the nose cone 109 properly aligns with the female housing 110 during mating.

Optionally, the male and female connectors 102, 104 in the connector system 100 may be standardized connectors, such as FAKRA standardized connectors. FAKRA is the Automotive Standards Committee in the German Institute for Standardization, representing international standardization interests in the automotive field. The FAKRA standard provides a system, based on keying and color coding, for proper connector attachment. For example, the keying ridges 142 of the male housing 108 and the key grooves 144 on the female housing 110 may be features designed according to desired FAKRA specifications for restricting the mate-ability of each of the connectors 102, 104 to one or more specific mating connectors.

Figure 2:
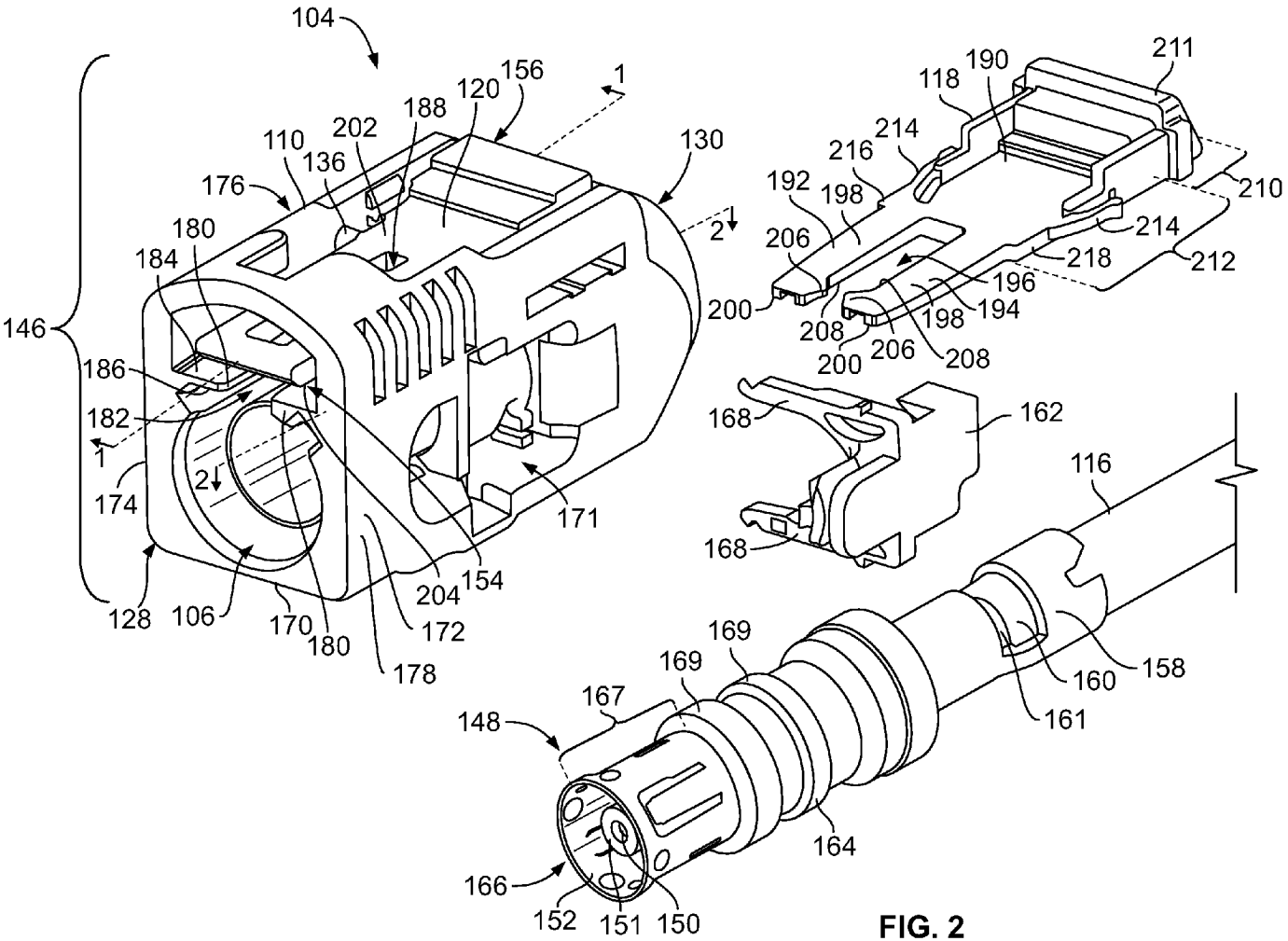
FIG. 2 is a partially exploded view of a female connector of the connector system according to an embodiment.

FIG. 2 is a partially exploded view of the female connector 104 according to an embodiment. The female connector 104 includes a housing assembly 146 and a contact assembly 148. In the illustrated embodiment, the housing assembly 146 is exploded, and the contact assembly 148 is intact. The housing assembly 146 includes the female housing 110, the CPA element 118, and a retainer clip 162. The retainer clip 162 is optional. In the illustrated embodiment, the housing 110 is a single, unitary component. In an alternative embodiment, the housing 110 may be an assembly of multiple discrete members, such as an upper housing member that includes the coupling lever 120 and a lower housing member that defines the cavity 106.

The contact assembly 148 may be a coaxial contact assembly including the center contact 150, a dielectric 151 surrounding the center contact 150, and the outer contact 152 surrounding the dielectric 151. The dielectric 151 provides electrical insulation between the center contact and the outer contact 152. The contact assembly 148 is terminated to the cable 116 by a ferrule 158 that is crimped around an outer jacket 160 of the cable 116. The ferrule 158 may also be crimped around a cable braid 161 of the cable 116. The contact assembly 148 also includes a cavity insert 164 that surrounds the outer contact 152. The cavity insert 164 is composed of a dielectric material to provide electrical insulation for the outer contact 152. The cavity insert 164 is also configured to interface with the housing 110 inside of the cavity 106 to secure the contact assembly 148 in position relative to the housing 110.

The connector 104 is assembled by inserting the contact assembly 148 into the cavity 106 of the female housing 110 through the rear end 130. A contact segment 167 of the contact assembly 148 extends from the cavity insert 164 to a distal end 166 of the contact assembly 148 relative to the cable 116. The contact segment 167 includes segments of the center contact 150, the dielectric 151, and the outer contact 152 that are configured to engage corresponding components of the male connector 102 (shown in FIG. 1) to electrically connect the connectors 102, 104 when the male connector 102 is fully loaded into the cavity 106.

The optional retainer clip 162 may be inserted into the female housing 110 through a side opening 171 of the housing 110. The retainer clip 162 is configured to be loaded in the housing 110 subsequent to the contact assembly 148 in order to secure the contact assembly 148 to the housing 110. For example, legs 168 of the retainer clip 162 may engage one or more flanges 169 of the cavity insert 164 to secure the axial position of the contact assembly 148 within the cavity 106.

The compositions and details of the housing 110 and the CPA element 118 are individually described below. The interoperability of the components will be explained with reference to succeeding figures. In an embodiment, the housing 110 and the CPA element 118 are composed of one or more dielectric materials, such as plastics. The housing 110 and the CPA element 118 are electrically insulative. The one or more dielectric materials of the housing 110 and the CPA element 118 need not be the same. The housing 110 and the CPA element 118 may be formed via molding processes, such as injection molding. In an alternative embodiment, the housing 110 and/or the CPA element 118 may be formed at least partially of a conductive metal material.

The female housing 110 includes the coupling lever 120 and a body 178 that defines the cavity 106. The body 178 includes a bottom wall 170, a first side wall 172, and an opposite second side wall 174. A top end 176 of the housing 110, opposite the bottom wall 170, is at least partially open. As used herein, relative or spatial terms such as "top," "bottom," "front," "rear," "first," and "second" are only used to distinguish the referenced elements of the female connector 104 and do not require particular positions or orientations relative to the direction of gravity and/or relative to the surrounding environment of the female connector 104, including the male connector 102 (shown in FIG. 1). The bottom wall 170, first side wall 172, and second side wall 174 all define respective portions of the cavity 106. The body 178 of the housing 110 further includes a platform 180 that at least partially defines the cavity 106. The platform 180 is disposed between the cavity 106 and the top end 176 of the housing 110. The platform 180 includes a top side 184 and a bottom side 186. The top side 184 faces the top end 176 of the housing 110, and the bottom side 186 defines a portion of the cavity 106. The platform 180 in the illustrated embodiment defines a channel 182 that extends through the platform 180 between the top side 184 and the bottom side 186. The channel 182 extends longitudinally rearward from the front end 128 of the housing 110. The channel 182 is configured to accommodate the tab 124 (shown in FIG. 1) of the male housing 108 (FIG. 1) therein as the male housing 108 enters the cavity 106.

The coupling lever 120 is disposed between the platform 180 and the top end 176 of the housing 110. The coupling lever 120 is mounted to the housing 110 via the fulcrum 136. In the illustrated embodiment, the fulcrum 136 is a cylindrical rod, but in other embodiments the fulcrum 136 may have other shapes. The fulcrum 136 extends between and is mounted to the side walls 172, 174 of the housing 110. The fulcrum 136 mounts to the side walls 172, 174 at spaced apart locations from the platform 180 between the platform 180 and the top end 176 of the housing 110. Optionally, instead of being a single rod that extends fully between the side walls 172, 174, the fulcrum 136 may include a first rod that extends from the coupling lever 120 to the first side wall 172 and a second rod that extends from the coupling lever 120 to the second side wall 174. In an embodiment, the coupling lever 120 is spaced apart from the platform 180 and does not engage the platform 180. The coupling lever 120 extends a length along the housing 110 between the front and rear ends 128, 130. For example, the first end 154 of the coupling lever 120 is proximate to the front end 128, and the second end 156 of the coupling lever 120 is proximate to the rear end 130.

The coupling lever 120 has a top side 202 and an opposite bottom side 204. The bottom side 204 faces the cavity 106. The coupling lever 120 optionally defines an indicator window 188 that extends through the coupling lever 120 between the top side 202 and the bottom side 204. The indicator window 188 may be used to determine whether or not the CPA element 118 is in the inserted position. For example, the CPA element 118 may be visible through the indicator window 188 when the CPA element 118 is in the inserted position, but is not visible through the window 188 when the CPA element 118 is in the extended position or is at an intermediate position between the extended and inserted positions.

The CPA element 118 includes a base 190 and first and second beams 192, 194 that extend from the base 190. Although two beams 192, 194 are shown in the illustrated embodiment, the CPA element 118 may include only one beam or more than two beams in other embodiments. The base 190 includes a raised section 210 that may have one or more stepped surfaces. The raised section 210 may include a bulbous, knob-like contact portion 211 that provides a place of contact for an operator to grip or otherwise engage the CPA element 118 in order to move the CPA element 118 between the extended and inserted positions. The base 190 in the illustrated embodiment further includes an intermediate section 212 that extends between the raised section 210 and the beams 192, 194 such that the beams 192, 194 extend from the intermediate section 212. The intermediate section 212 has a reduced height relative to the raised section 210. Optionally, at least a majority of the intermediate section 212 is planar.

The first and second beams 192, 194 extend parallel to one another and in a same general direction from the base 190. The beams 192, 194 are spaced apart from each other to define a lateral gap 196 therebetween. The beams 192, 194 have identical or at least similar shapes that mirror one another. For example, the beams 192, 194 each include an arm 198 that extends from the base 190 to a distal end 200 of the respective beam 192, 194. The arms 198 may be planar. For example, each arm may include two opposite planar broad sides and two edge sides that extend between the broad sides. The beams 192, 194 are configured to deflect along a plane that is parallel to the planar broad sides. In an embodiment, at least a portion of both beams 192, 194 extends towards the other beam 192, 194. For example, in the illustrated embodiment, each beam 192, 194 includes a finger 206 that projects from an interior edge side 208 of the respective arm 198. The fingers 206 of the beams 192, 194 may be located proximate to the distal ends 200. The fingers 206 may be protrusions of various sizes and/or shapes. For example, the fingers 206 may be bumps, barbs, lips, ledges, detents, or the like, having curved or linear surfaces. The finger 206 of the first beam 192 extends towards the finger 206 of the second beam 194 across the gap 196. As such, a width of the gap 196 between the first and second beams 192, 194 is reduced between the fingers 206 relative to the width of the gap 196 between the arms 198 at a spaced apart location from the fingers 206.

In an embodiment, the CPA element 118 also includes side retention latches 214. The side retention latches 214 are cantilevered and extend laterally outward from the intermediate section 212 of the base 190. One side retention latch 214 extends from a left side 216 of the CPA element 118, and the other side retention latch 214 extends from an opposite right side 218 of the CPA element 118. The retention latches 214 are configured to engage the female housing 110 to retain the CPA element 118 on the housing 110.

Figure 3:
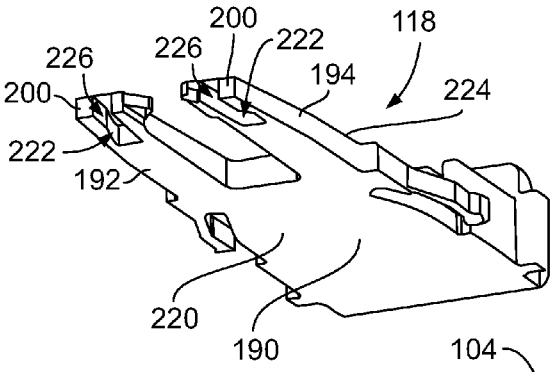
FIG. 3 is a bottom perspective view of a CPA element of the female connector according to an embodiment.

FIG. 3 is a bottom perspective view of the CPA element 118 according to an embodiment. The CPA element 118 is substantially planar along a bottom side 220 thereof. For example, the CPA element 118 may be configured to engage and slide along the top side 184 (shown in FIG. 2) of the platform 180 (FIG. 2) along the actuation path between the extended and inserted positions. In an embodiment, the first and second beams 192, 194 each define a slot 222 that extends along a length of the respective beam 192, 194 from the distal end 200 towards the base 190. The slots 222 are open along the bottom side 220 but are closed off from an opposite, top side 224 of the CPA element 118. Alternatively, the slots 222 may be open along both the top and bottom sides 224, 220. The distal ends 200 define openings 226 to the respective slots 222. As described below, the slots 222 are each configured to receive a corresponding protrusion 232 (shown in FIG. 4) of the female housing 110 (FIG. 1) therein as the CPA element 118 is moved from the extended position to the inserted position. In an alternative embodiment, only one of the beams 192, 194 includes a slot 222. In another alternative embodiment, neither of the beams 192, 194 defines a slot 222.

Figure 4:
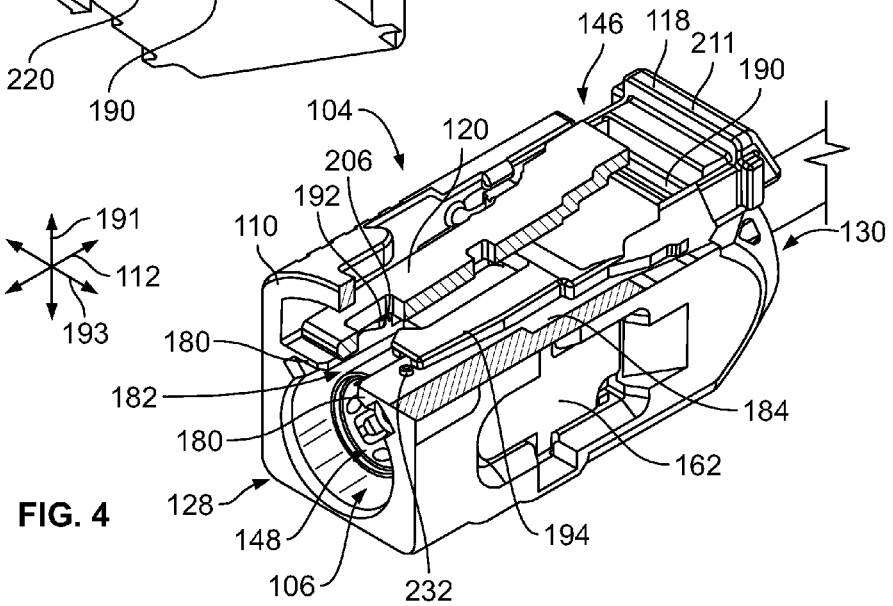
FIG. 4 is a top perspective view of the female connector in an assembled state according to an embodiment.

FIG. 4 is a top perspective view of the female connector 104 in an assembled state according to an embodiment. The contact assembly 148 is loaded within the cavity 106 of the housing assembly 146. In FIG. 4, the female housing 110 is sectioned along the lines 1-1 and 2-2 shown in FIG. 2. The CPA element 118 and the retainer clip 162 are both mounted to the housing 110. The female connector 104 is oriented with respect to a vertical or elevation axis 191, a lateral axis 193, and the mating axis 112. The axes 191, 193, 112 are mutually perpendicular. Although the elevation axis 191 appears to extend in a generally parallel to gravity, it is understood that the axes 191, 193, 112 are not required to have any particular orientation with respect to gravity.

The CPA element 118 is located in the extended position in the illustrated embodiment. The CPA element 118 is configured to be moved relative to the housing 110 to the inserted position (shown in FIGS. 8 and 9) responsive to the male connector 102 (shown in FIG. 1) being fully loaded in the cavity 106 of the female housing 110. The CPA element 118 moves linearly along an actuation path that is parallel to the mating axis 112. The CPA element 118 in the inserted position is more proximate to the front end 128 of the housing 110 than when the CPA element 118 is in the extended position. For example, in the extended position, the contact portion 211 of the base 190 may at least partially extend beyond the rear end 130 of the housing 110, but the contact portion 211 optionally does not extend beyond the rear end 130 when the CPA element 118 is in the inserted position. The first and second beams 192, 194 extend from the base 190 towards the front end 128. The first beam 192 is substantially covered by the coupling lever 120 in the illustrated embodiment, such that the finger 206 of the first beam 192 is the only visible component of the first beam 192.

In an embodiment, the CPA element 118 is disposed between the coupling lever 120 and the platform 180. For example, the bottom side 220 (shown in FIG. 3) of the CPA element 118 engages the top side 184 of the platform 180 and slides along the top side 184 along the actuation path. The beams 192, 194 of the CPA element 118 may engage the top side 184 in both the extended position and the inserted position of the CPA element 118. The first beam 192 extends along the top side 184 on one side (for example, to the left) of the channel 182, and the second beam 194 extends along the top side 184 on an opposite side (for example, to the right) of the channel 182.

The beams 192, 194 are deflectable between a blocked position of the beams 192, 194 and a clearance position of the beams 192, 194. For example, when the CPA element 118 is in the extended position and the beams 192, 194 are in the blocked position, one or both of the beams 192, 194 is configured to abut a corresponding protrusion 232 extending from the housing 110. The protrusion 232 mechanically blocks the CPA element 118 from moving from the extended position to the inserted position. Thus, the protrusion 232 is in the path of the corresponding beam 192, 194. The protrusion 232 is fixed to the housing 110. The protrusion 232 may abut the corresponding beam 192, 194 when the CPA element 118 is in the extended position, or may be at least slightly spaced apart from the corresponding beam 192, 194 such that the protrusion 232 only makes contact with the beam 192, 194 when movement of the CPA element 118 to the inserted position is attempted (while the male connector 102 is not fully mated to the female connector 104).

Figure 5:
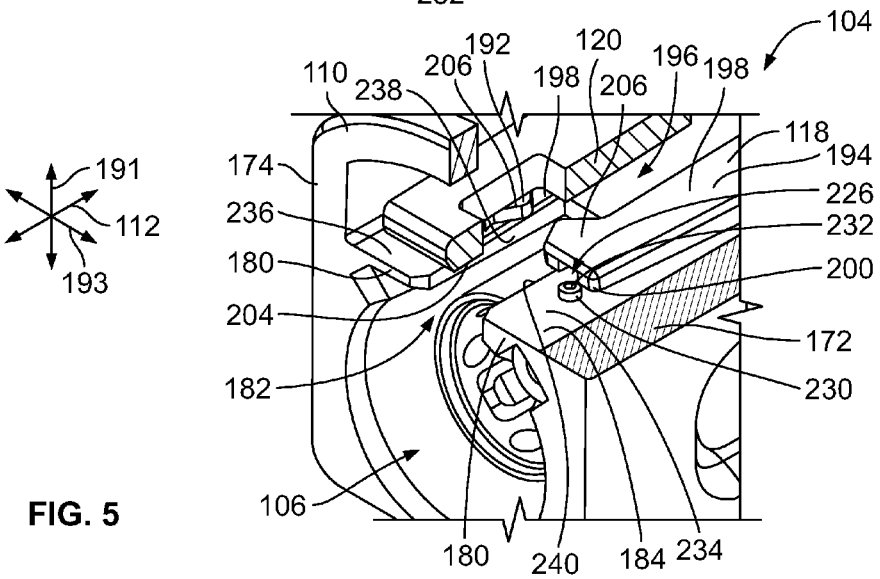
FIG. 5 is a close-up perspective view of a portion of the female connector shown in FIG. 4.

FIG. 5 is a close-up perspective view of a portion of the female connector 104 shown in FIG. 4. In an embodiment, the protrusion 232 extends from the top side 184 of the platform 180. Alternatively, the protrusion 232 may extend from the bottom side 204 of the coupling lever 120, from one of the side walls 172, 174 of the housing 110, or the like. In the illustrated embodiment, the protrusion 232 is a post that extends vertically (along the elevation axis 191) from the top side 184. The post 232 may be cylindrical, defining a curved hard stop surface 230 that is configured to abut (for example, contact directly) the corresponding beam 192, 194. In other embodiments, the protrusion 232 may have other shapes and sizes, such as a cuboid, a barb, a bump, or the like, that includes a hard stop surface that blocks movement of the CPA element 118 to the inserted position when the beams 192, 194 are in the blocked position. In the illustrated embodiment, only one protrusion 232 is visible. The protrusion 232 is disposed on a right segment 234 of the platform 180 that is between the channel 182 and the first side wall 172 of the housing 110. The protrusion 232 is configured to abut the second beam 194. Optionally, the housing 110 may further include a second protrusion 232B (shown in FIG. 6) that is disposed on a left segment 236 of the platform 180 between the channel 182 and the second side wall 174. The second protrusion 232B is configured to abut the first beam 192. The second protrusion 232B may be identical or at least similar to the first protrusion 232A that abuts the second beam 194.

In an embodiment, the distal end 200 of the beam 194 is configured to abut the protrusion 232 extending from the right segment 234. For example, a portion of the distal end 200 adjacent to the opening 226 engages the protrusion 232 when the beam 194 is in the blocked position. Thus, the opening 226 to the slot 222 (shown in FIG. 3) of the beam 194 does not align with the protrusion 232 when the beam 194 is in the blocked position. In an alternative embodiment, the portion of the beam 194 that engages the protrusion 232 may be spaced apart from the distal end 200.

In an embodiment, the beams 192, 194 are configured to be engaged by the male connector 102 (shown in FIG. 1) as the male connector 102 is loaded into the cavity 106. The male connector 102 deflects the beams 192, 194 from the blocked position to a clearance position. In an embodiment, the beams 192, 194 may be at a resting or unbiased state in the blocked position, and the male connector 102 forces the beams 192, 194 to a biased, defected state to reach the clearance position. In the clearance position, the beams 192, 194 clear the hard stop surface(s) 230 of the protrusion(s) 232, which allows the CPA element 118 to be moved from the extended position to the inserted position. The male connector 102 deflects the beams 192, 194 to the clearance position responsive to the male connector 102 reaching the fully mated position relative to the female connector 104. The beams 192, 194 do not achieve the clearance position until the male connector 102 is fully mated to the female connector 104, so the CPA element 118 is not able to be moved to the inserted position until the male and female connectors 102, 104 are fully mated.

In an embodiment, the beams 192, 194 of the CPA element 118 are configured to be engaged and deflected by the tab 124 (shown in FIG. 1) of the male connector 102 (FIG. 1). The tab 124 protrudes through the channel 182 of the platform 180 and at least partially into the gap 196 between the beams 192, 194. The tab 124 deflects the beams 192, 194 laterally outward relative to the channel 182 such that the beams 192, 194 deflect away from each other. The beams 192, 194 may be configured to deflect generally along the lateral axis 193 (although it is recognized that the deflection of the beams 192, 194 will be arced or curved and not linear). Thus, the beams 192, 194 deflect generally transverse to the mating axis 112 as the tab 124 moves along the mating axis 112. In the illustrated embodiment, the arms 198 of the beams 192, 194 are spaced apart laterally from the channel 182, and the fingers 206 extend from the arms 198 beyond corresponding left and right edges 238, 240 of the channel 182 into alignment with the channel 182. Thus, the fingers 206 extend laterally into alignment with the channel 182. As the male connector 102 is received in the cavity 106, the tab 124 protrudes through the channel 182 and engages the fingers 206 of the beams 192, 194 to deflect the beams 192, 194 from the blocked position to the clearance position.

Figure 6:
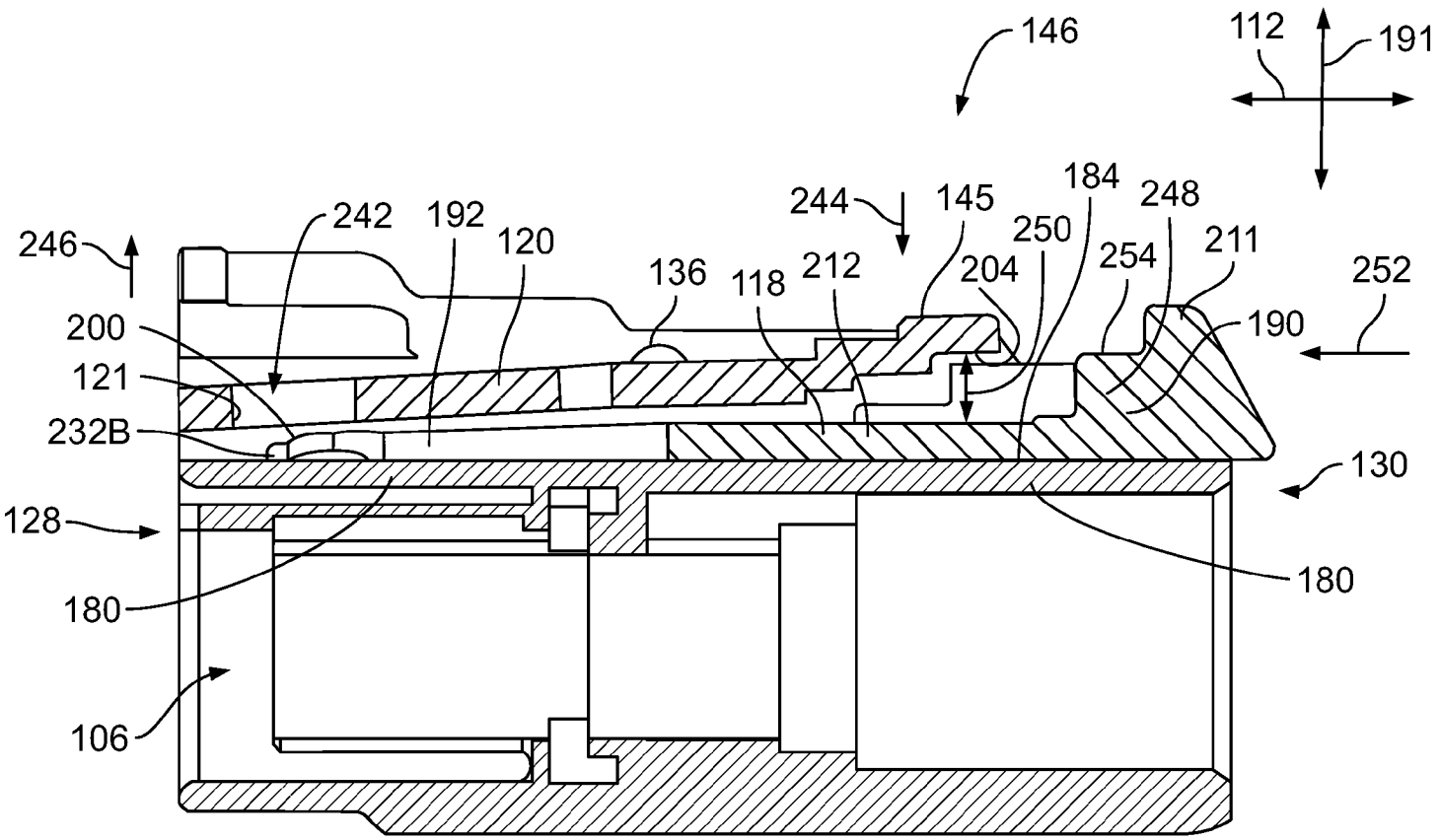
FIG. 6 is a cross-sectional view of an assembled housing assembly of the female connector taken along the line 1-1 shown in FIG. 2 according to an embodiment when the CPA element is in an extended position.

FIG. 6 is a cross-sectional view of the assembled housing assembly 146 taken along the line 1-1 shown in FIG. 2 according to an embodiment. The CPA element 118 is in the extended position in FIG. 6. FIG. 6 shows the second protrusion 232B abutting the distal end 200 of the first beam 192 to block movement of the CPA element 118 to the inserted position. The CPA element 118 engages and slides along the top side 184 of the platform 180. As shown in the illustrated embodiment, the coupling lever 120 is vertically spaced apart from the platform 180 and does not engage the platform 180. The CPA element 118 is disposed between the coupling lever 120 and the platform 180.

The latching surface 121 is disposed on one side of the fulcrum 136 between the fulcrum 136 and the front end 128. In an embodiment, the latching surface 121 of the coupling lever 120 is a rear-facing surface that is a front wall of an aperture 242 defined through the coupling lever 120. The button segment 145 of the coupling lever 120 is disposed on an opposite side of the fulcrum 136 between the fulcrum 136 and the rear end 130. The button segment 145 is configured to be depressed in a direction 244 towards the cavity 106 in order to pivot the coupling lever 120 to lift the latching surface 121 in a direction 246 away from the cavity 106. For example, in the illustrated orientation, the button segment 145 is pressed in a vertically downward direction 244, and the latching surface 121 is lifted in a vertically upward direction 246. The pivoting of the coupling lever 120 may be used to selectively release the catch 122 (shown in FIG. 1) of the male connector 102 (FIG. 1), allowing the male connector 102 to un-mate or disconnect from the female connector 104.

Figure 9:
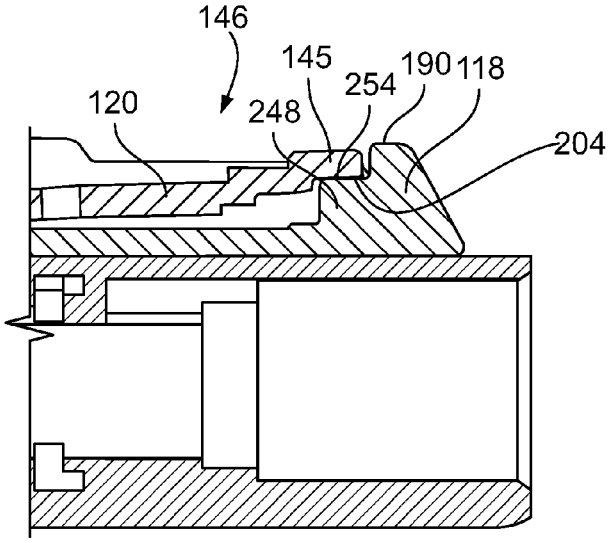
FIG. 9 is a cross-sectional view of a portion of the housing assembly of the female connector with the CPA element in the inserted position.

In an embodiment, the base 190 includes a seat portion 248 that is proximate to the contact portion 211. Optionally, the seat portion 248 may be defined by the contact portion 211. The seat portion 248 is vertically taller than the intermediate section 212 of the base 190. When the CPA element 118 is in the extended position as shown, the seat portion 248 of the base 190 is disposed rearward of the coupling lever 120. The button segment 145 of the coupling lever 120 extends above the intermediate section 212 of the base 190 and is spaced apart vertically from the intermediate section 212 by a clearance gap 250. The clearance gap 250 is large enough to allow the button segment 145 to be depressed in the direction 244 for a sufficient distance to lift the latching surface 121 above the catch 122 (FIG. 1) of the male connector 102 (FIG. 1). When the CPA element 118 is moved in an insertion direction 252 to the inserted position, the seat portion 248 of the base 190 extends under the button segment 145, as shown in FIG. 9. The seat portion 248 is tall, so the clearance gap 250 is reduced. Depression of the button segment 145 causes the bottom side 204 of the lever 120 to engage a top surface 254 of the seat portion 248, which blocks the coupling lever 120 from pivoting to an extent necessary to disconnect the latching surface 121 from the catch 122. Thus, the CPA element 118 in the inserted position is configured to provide a secondary lock that prevents or at least prohibits the ability for the male and female connectors 102, 104 to uncouple from each other until the CPA element 118 is moved to the extended position.

Figure 7:
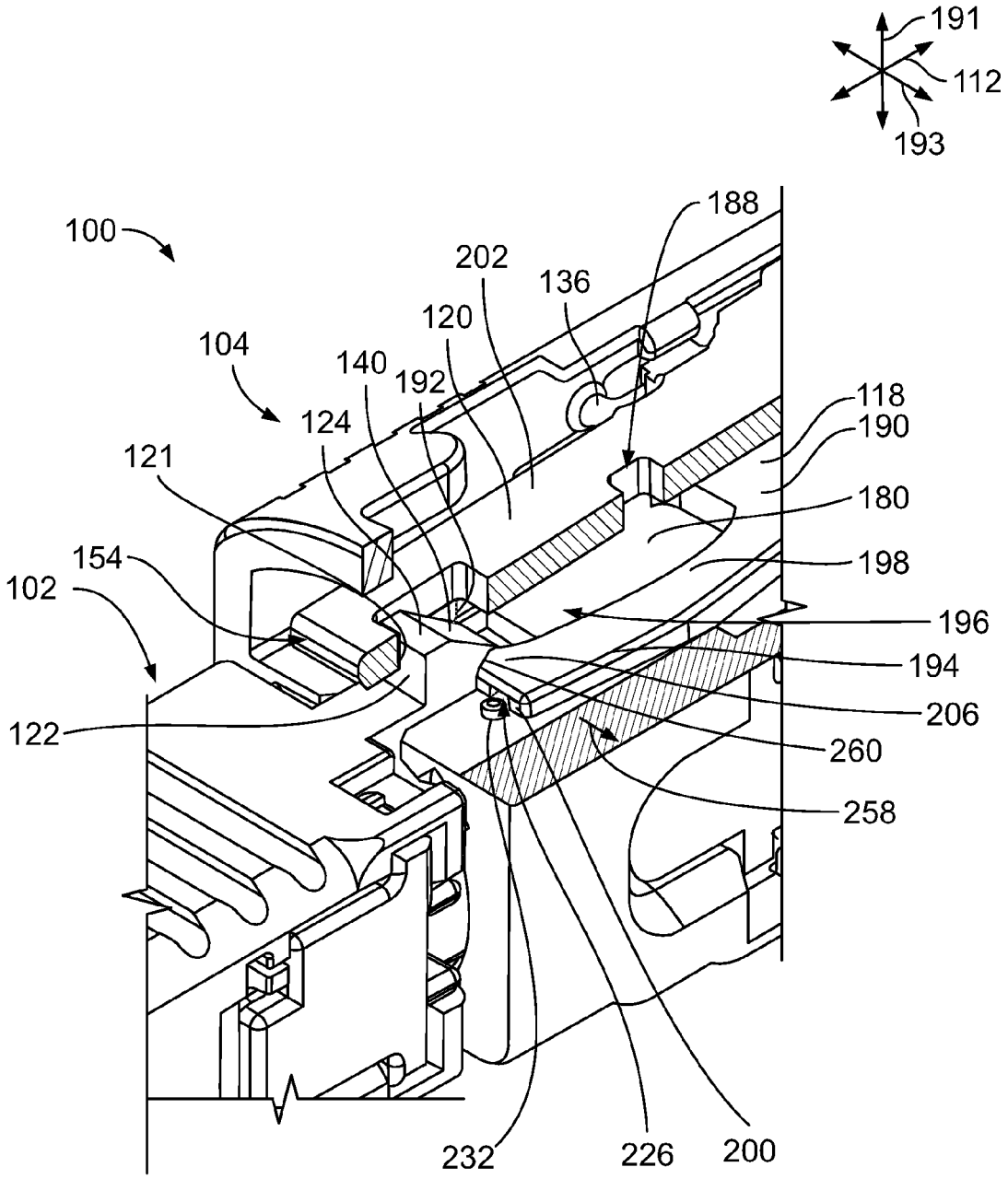
FIG. 7 is a perspective view of a portion of the connector system in a fully mated state of the male and female connectors according to an embodiment.

FIG. 7 is a perspective view of a portion of the connector system 100 in a fully mated state of the male and female connectors 102, 104. As the male connector 102 is loaded into the cavity 106 (shown in FIG. 1), the tab 124 may engage the first end 154 of the coupling lever 120. For example, the ramp 140 of the tab 124 engages the first end 154 and forces the lever 120 to pivot about the fulcrum 136 as the ramp 140 lifts the first end 154. Upon reaching the fully mated position, the latching surface 121 of the lever 120 is configured to engage the catch 122 of the tab 124 to secure the male connector 102 to the female connector 104.

The movement of the male connector 102 along the mating axis 112 causes the tab 124 to extend at least partially into the gap 196 between the beams 192, 194. A front edge 256 (shown in FIG. 1) of the tab 124 engages the fingers 206 of the beams 192, 194 and forces the beams 192, 194 to deflect outward. For example, the second beam 194 deflects outward in a deflection direction 258. The beam 194 may deflect along the length of the arm 198 and/or at the intersection between the arm 198 and the base 190. In an embodiment, the finger 206 of the beam 194 has a lead-in ramp surface 260. The front edge 256 of the tab 124 engages and slides along the ramp surface 260 to gradually increase the amount of deflection of the beam 194 without stubbing. The finger 206 of the beam 192 may be identically or at least similarly shaped as the finger 206 of the beam 194. Once the male connector 102 is in the fully mated position, the beams 192, 194 attain the clearance position. As the tab 124 is held in place by the interaction between the catch 122 and the latching surface 121, the tab 124 holds the beams 192, 194 in the clearance position.

In the clearance position, the beams 192, 194 are able to bypass the corresponding protrusions 232 because the tab 124 holds the beams 192, 194 in a deflected state. In an embodiment, the opening 226 at the distal end 200 of the beam 194 aligns with the protrusion 232 when the beam 194 is in the clearance position. Thus, the beam 194 is able to bypass the protrusion 232 as the CPA element 118 is moved to the inserted position because the protrusion 232 is received in the slot 222 (shown in FIG. 3) of the beam 194 through the opening 226. In an alternative embodiment, the beam 194 may be shaped such that the beam 194 in the clearance position is spaced apart laterally from the protrusion 232 instead of defining a slot 222 that receives the protrusion 232 therein.

In FIG. 7, the CPA element 118 is still in the extended position although the CPA element 118 is not blocked from being moved to the inserted position. In the extended position, the CPA element 118 is not visible through the indicator window 188 when viewed from above the top side 202 of the coupling lever 120. For example, although the coupling lever 120 is shown in cross-section in FIG. 7, a person viewing the indicator window 188 from above the top side 202 would see a portion of the platform 180 between the beams 192, 194, and would not see the CPA element 118 through the window 188.

Figure 8:
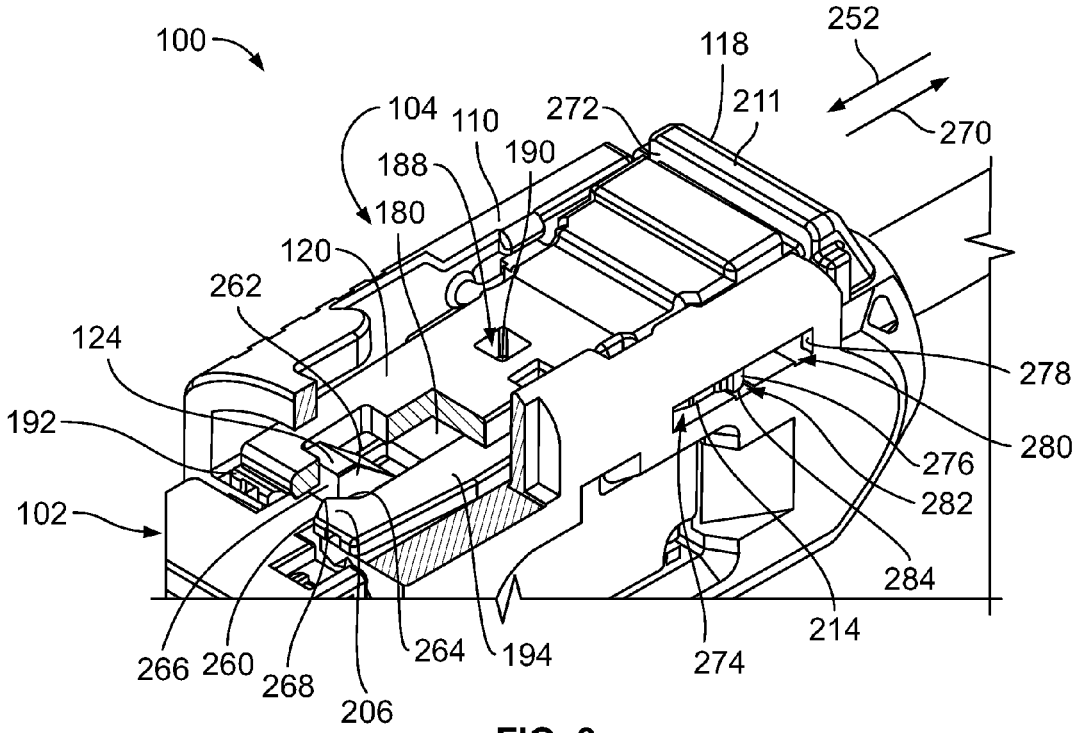
FIG. 8 is a perspective view of a portion of the connector system in the fully mated state of the male and female connectors with the CPA element in an inserted position.

FIG. 8 is a perspective view of a portion of the connector system 100 in the fully mated state of the male and female connectors 102, 104 with the CPA element 118 in the inserted position. The CPA element 118 is able to be moved to the inserted position after the male connector 102 is fully mated to the female connector 104, and the beams 192, 194 are deflected to the clearance position, as described with reference to FIG. 7. As the CPA element 118 is moved by a human operator or a robot in the insertion direction 252 relative to the female housing 110 and the tab 124, the finger 206 of the beam 194 engages and slides along a side wall 262 of the tab 124. The beam 194 remains in a deflected state, so the beam 194 applies a force against the tab 124 due to the resilient bias in the beam 194.

In an embodiment, the finger 206 includes a hook surface 264 that is rearward of the ramp surface 260. As the CPA element 118 approaches the inserted position, the hook surface 264 may engage a rear edge 266 of the tab 124. For example, as an apex 268 of the finger 206 extends beyond the read edge 266, the bias of the beam 194 forces the beam 194 to resiliently return towards an undeflected state, such that the beam 194 moves towards the other beam 192 (and vice-versa). The apex 268 is disposed between the ramp surface 260 and the hook surface 264. The hook surface 264 engages the rear edge 266 of the tab 124 to provide a sensory indication that the CPA element 118 has reached the inserted position. For example, the engagement between the hook surface 264 and the rear edge 266 may provide a tactile or audible indication. The hook surface 264 may provide a soft stop that restricts the CPA element 118 from unintentionally sliding from the inserted position in an extension direction 270 towards the extended position. The hook surface 264 optionally may also force the tab 124 rearward to retain the male connector 102 in the fully mated position and/or to pull the male connector 102 from a substantially fully mated position to an absolute fully mated position.

As shown in FIG. 8, when the CPA element 118 is in the inserted position, the CPA element 118 is visible through the indicator window 188 of the coupling lever 120. For example, a portion of the base 190 is visible through the indicator window 188. The CPA element 118 may have a distinct or recognizable color or pattern such that the human operator or robot is able to distinguish the CPA element 118 in the window 188 from the platform 180 of the housing 110 (visible through the window 188 when the CPA element 118 is in the extended position).

FIG. 9 is a cross-sectional view of a portion of the housing assembly 146 of the female connector 104 (shown in FIG. 1) with the CPA element 118 in the inserted position. In the inserted position, the seat portion 248 of the base 190 extends under the button segment 145. The top surface 254 of the seat portion 248 is configured to engage the bottom side 204 of the lever 120 to mechanically block the coupling lever 120 from pivoting to an extent necessary to disconnect the latching surface 121 (shown in FIG. 7) from the catch 122 (FIG. 7). Thus, the CPA element 118 in the inserted position is configured to provide a secondary lock that prevents or at least prohibits the ability for the male and female connectors 102, 104 to uncouple from each other until the CPA element 118 is moved back to the extended position.

With additional reference to FIG. 8, in order to subsequently disconnect the male connector 102 from the female connector 104, the CPA element 118 is configured to be moved in the extension direction 270 by engaging a front wall 272 of the contact portion 211 and pushing or pulling the contact portion 211 of the CPA element 118 in the extension direction 270 with sufficient force to overcome the soft stop provided by the interaction of the hook surface 264 and the rear edge 266 of the tab 124.

As shown in FIG. 8, the side retention latch 214 of the CPA element 118 extends within a side window 274 of the housing 110. A distal, free end 276 of the retention latch 214 is configured to abut a rear wall 278 of the side window 274 to prohibit the CPA element 118 from being pulled too far in the extension direction 270 such that the CPA element 118 uncouples from the housing 110. The side window 274 optionally includes a first detent 280 and a second detent 282. The free end 276 of the latch 214 includes a bump 284 that is configured to be received in the first detent 280 when the CPA element 118 is in the extended position and in the second detent 282 when the CPA element 118 is in the inserted position. The movement of the bump 284 relative to the detents 280, 282 may provide sensory feedback (for example, tactile, visual, and/or audible) for an operator or robot that moves the CPA element 118.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. An electrical connector comprising:

a housing having a front end and defining a cavity at the front end that is oriented along a mating axis, the cavity configured to receive a mating connector therein that is loaded along the mating axis, the housing including a first protrusion that defines a hard stop surface; and a connector position assurance (CPA) element mounted on the housing and moveable relative to the housing parallel to the mating axis between an extended position and an inserted position, the CPA element, in the inserted position, disposed more proximate to the front end of the housing than when the CPA element is in the extended position, the CPA element including a base and a first beam extending from the base towards the front end of the housing, the first beam configured to be engaged by the mating connector and deflected from a blocked position to a clearance position as the mating connector is loaded into the cavity, the first beam of the CPA element being deflected generally transverse to the mating axis from the blocked position to the clearance position, wherein, when the first beam of the CPA element is in the blocked position, movement of the CPA element from the extended position to the inserted position is mechanically blocked by the hard stop surface of the first protrusion abutting the first beam of the CPA element, and wherein, when the first beam of the CPA element is moved to the clearance position by the mating connector, the first beam clears the hard stop surface of the first protrusion to allow the CPA element to be moved from the extended position to the inserted position.

2. The electrical connector of claim 1, wherein the first beam extends from the base of the CPA element to a distal end of the first beam, the distal end of the first beam configured to abut the hard stop surface of the first protrusion when the first beam is in the blocked position to block movement of the CPA element from the extended position to the inserted position.

3. The electrical connector of claim 1, wherein the first beam includes a slot that extends along a length of the first beam from a distal end of the first beam towards the base of the CPA element, the distal end defining an opening to the slot, the opening not aligning with the first protrusion when the first beam is in the blocked position, the opening aligning with the first protrusion when the first beam is in the clearance position such that the first protrusion is received in the slot through the opening as the CPA element is moved towards the inserted position.

4. The electrical connector of claim 1, wherein the housing includes a platform that has a top side and a bottom side, the bottom side at least partially defining the cavity, the CPA element configured to slide along the top side of the platform parallel to the mating axis between the extended position and the inserted position, the first beam of the CPA element deflecting laterally along a surface of the top side from the blocked position to the clearance position responsive to the mating connector being loaded into the cavity.

5. The electrical connector of claim 1, wherein the housing further includes a body that defines the cavity and a coupling lever that is pivotable relative to the body about a fulcrum, the coupling lever including a latching surface that engages a catch of the mating connector when the mating connector is in a fully mated position to secure the mating connector to the housing.

6. The electrical connector of claim 5, wherein the CPA element is disposed between the coupling lever and a platform of the body of the housing, the CPA element being slidable between the extended and inserted positions along a top side of the platform that faces the coupling lever, the first beam engaging the top side in both the blocked position and the clearance position.

7. The electrical connector of claim 6, wherein the latching surface of the coupling lever is disposed on one side of the fulcrum and the coupling lever includes a button segment that is disposed on an opposite side of the fulcrum, the button segment configured to be depressed towards the cavity to lift the latching surface in a direction away from the cavity to selectively release the catch of the mating connector, the base of the CPA element having a seat portion that is disposed under the button segment and mechanically blocks depression of the button segment when the CPA element is in the inserted position, the seat portion not blocking depression of the button segment when the CPA element is in the extended position.

8. The electrical connector of claim 6, wherein the coupling lever defines an indicator window extending through the coupling lever between a top side and a bottom side thereof, the CPA element between the coupling lever and the platform being visible in the indicator window from above the top side of the coupling lever when the CPA element is in the inserted position, the CPA element not visible in the indicator window when the CPA element is in the extended position.

9. The electrical connector of claim 1, wherein the housing includes a platform that has a top side and a bottom side, the bottom side at least partially defining the cavity, the CPA element being slidable along the top side of the platform, the first protrusion being a post that extends vertically upwards from the top side of the platform.

10. The electrical connector of claim 1, wherein the CPA element further includes a second beam that extends from the base towards the front end of the housing, the first and second beams being spaced apart from one another by a gap, a tab of the mating connector configured to be received at least partially into the gap as the mating connector is received in the cavity, the tab engaging and deflecting the first and second beams laterally outward and away from one other.

11. The electrical connector of claim 10, wherein the first beam has a finger that projects from an interior edge side of the first beam, a front edge of the tab of the mating connector engaging the finger of the first beam as the mating connector is loaded into the cavity to deflect the first beam from the blocked position to the clearance position, wherein, as the CPA element is moved towards the inserted position, the finger engages a side wall of the tab and subsequently engages a rear edge of the tab.

12. An electrical connector comprising:

a housing having a front end and defining a cavity at the front end that is configured to receive a mating connector therein, the housing including a first protrusion that defines a hard stop surface; and a connector position assurance (CPA) element mounted on the housing and moveable relative to the housing between an extended position and an inserted position, the CPA element in the inserted position being more proximate to the front end of the housing than when the CPA element is in the extended position, the CPA element including a base and two beams extending from the base towards the front end of the housing, the beams spaced apart from one another by a gap, the beams configured to receive a tab of the mating connector into the gap as the mating connector is received in the cavity, the tab engaging and deflecting the first and second beams laterally outward relative to one another from a blocked position of the beams to a clearance position of the beams, wherein, when the beams of the CPA element are in the blocked position, movement of the CPA element from the extended position to the inserted position is mechanically blocked by the hard stop surface of the first protrusion abutting at least one of the beams of the CPA element, and wherein, when the beams of the CPA element are in the clearance position, the beams clear the hard stop surface of the first protrusion to allow the CPA element to be moved from the extended position to the inserted position.

13. The electrical connector of claim 12, wherein the housing includes a platform that has a top side and a bottom side, the bottom side at least partially defining the cavity, the platform defining a channel therethrough that is open to the cavity, the CPA element being slidable along the top side of the platform, the tab of the mating connector protruding through the channel and into the gap to engage and deflect the beams of the CPA element as the mating connector is loaded in the cavity.

14. The electrical connector of claim 13, wherein the first beam of the CPA element extends along the top side of the platform to the left of the channel and the second beam of the CPA element extends along the top side of the platform to the right of the channel, wherein the first protrusion is a post that extends from the top side of the platform along a left segment of the platform to abut the first beam when the beams are in the blocked position, the housing further including a second protrusion that is a post extending from the top side of the platform along a right segment of the platform to abut the second beam when the beams are in the blocked position.

15. The electrical connector of claim 13, wherein the first beam of the CPA element extends along the top side of the platform to the left of the channel and the second beam of the CPA element extends along the top side of the platform to the right of the channel, the first and second beams each including a finger projecting from an interior edge side of the respective beam, the fingers of the first and second beams extending beyond corresponding left and right edges of the channel into alignment with the channel to engage the tab of the mating connector that extends through the channel.

16. The electrical connector of claim 12, wherein the beams of the CPA element mirror one another across the gap.

17. An electrical connector comprising:

a housing having a body, a coupling lever, and a post, the body defining a cavity at a front end of the housing that is configured to receive a mating connector therein, the body further including a platform with a top side that faces the coupling lever, the coupling lever pivotable relative to the body about a fulcrum, the coupling lever including a latching surface that engages a catch of the mating connector when the mating connector is in a fully mated position to secure the mating connector to the housing, the post extending vertically upwards from the top side of the platform and defining a hard stop surface; and a connector position assurance (CPA) element mounted on the housing and disposed between the coupling lever and the platform of the body, the CPA element slidable between an extended position and an inserted position along the top side of the platform, the CPA element, in the inserted position, disposed more proximate to the front end of the housing than when the CPA element is in the extended position, the CPA element including a base and a first beam extending from the base towards the front end of the housing, the first beam configured to be engaged by the mating connector and deflected from a blocked position to a clearance position as the mating connector is loaded into the cavity, wherein, when the first beam of the CPA element is in the blocked position, movement of the CPA element from the extended position to the inserted position is mechanically blocked by the hard stop surface of the post abutting the first beam of the CPA element, and wherein, when the first beam of the CPA element is moved to the clearance position by the mating connector, the first beam clears the hard stop surface of the post to allow the CPA element to be moved from the extended position to the inserted position.

18. The electrical connector of claim 17, wherein the latching surface of the coupling lever is disposed on one side of the fulcrum and the coupling lever includes a button segment that is disposed on an opposite side of the fulcrum, the button segment configured to be depressed towards the cavity to lift the latching surface in a direction away from the cavity to selectively release the catch of the mating connector, the base of the CPA element having a seat portion that is disposed under the button segment and mechanically blocks depression of the button segment when the CPA element is in the inserted position, the seat portion not blocking depression of the button segment when the CPA element is in the extended position.

19. The electrical connector of claim 17, wherein the coupling lever defines an indicator window extending through the coupling lever between a top side and a bottom side thereof, the CPA element between the coupling lever and the platform being visible in the indicator window from above the top side of the coupling lever when the CPA element is in the inserted position, the CPA element not visible in the indicator window when the CPA element is in the extended position.

20. The electrical connector of claim 17, wherein the first beam attains the clearance position responsive to the mating connector substantially reaching the fully mated position.

* * * * *